US005409506A

United States Patent [19]

Baillargeon et al.

[11] Patent Number: 5,409,506

[45] Date of Patent: Apr. 25, 1995

[54] MULTIFUNCTIONAL FUEL ADDITIVES AND COMPOSITIONS THEREOF

[75] Inventors: David J. Baillargeon, West Windsor Township, Middlesex County; Angeline B. Cardis, Florence; Dale B. Heck, West Deptford, all of N.J.

[73] Assignee: Mobil Oil Corporation, Fairfax, Va.

[21] Appl. No.: 121,091

[22] Filed: Sep. 14, 1993

Related U.S. Application Data

[60] Continuation of Ser. No. 667,147, Mar. 11, 1991, abandoned, which is a division of Ser. No. 449,186, Dec. 13, 1989, Pat. No. 5,002,589.

[51] Int. Cl.[6] ..... C10L 1/22

[52] U.S. Cl. ..... 44/386; 44/391; 44/399; 525/347; 560/88; 560/90

[58] Field of Search ..... 44/386, 389, 391, 399; 525/420, 434, 347; 564/134, 144, 169; 560/88, 90

[56] References Cited

U.S. PATENT DOCUMENTS

| | | | |
|---|---|---|---|
| 2,594,145 | 4/1952 | Flory | 525/420 |
| 3,397,255 | 8/1968 | Coats et al. | 525/437 |
| 3,882,085 | 5/1975 | Schmitt et al. | 525/420 |
| 4,061,621 | 12/1977 | Lofquist | 525/420 |
| 4,236,898 | 12/1980 | Davis et al. | 44/418 |
| 4,290,778 | 9/1981 | Herbstman et al. | 44/307 |
| 4,328,142 | 5/1982 | Hertel et al. | 525/420 |
| 4,402,708 | 9/1983 | Oswald | 44/304 |
| 4,404,001 | 9/1983 | Kaufman | 44/406 |
| 4,430,093 | 2/1984 | Jenkins, Jr. | 44/398 |
| 4,659,337 | 4/1987 | Sung | 44/407 |
| 4,690,980 | 9/1987 | Singer et al. | 525/286 |
| 4,732,948 | 3/1988 | McCready et al. | 525/437 |
| 4,744,798 | 5/1988 | Andress | 44/418 |
| 5,002,589 | 3/1991 | Baillargeon | 44/399 |
| 5,039,308 | 8/1991 | Baillargeon | 44/351 |

*Primary Examiner*—Margaret Medley
*Attorney, Agent, or Firm*—Alexander J. McKillop; Malcolm D. Keen; Charles A. Malone

[57] ABSTRACT

Additives which improve the low-temperature properties of distillate fuels are the reaction products of (1) diaminodiols, and (2) the product of pyromellitic dianhydride and aminoalcohols and/or amines with long-chain hydrocarbyl groups attached.

18 Claims, No Drawings

MULTIFUNCTIONAL FUEL ADDITIVES AND COMPOSITIONS THEREOF

This is a continuation of application Ser. No. 07/667,147, filed on Mar. 11, 1991, now abandoned, which is a division of application Ser. No. 07/449,186, filed on Dec. 13, 1989, now U.S. Pat. No. 5,002,589.

BACKGROUND OF THE INVENTION

This application is directed to novel additives for liquid hydrocarbyl fuels, especially distillate fuels and to fuel compositions containing same.

Traditionally, the low-temperature properties of distillate fuels have been improved by the addition of kerosene, sometimes in very large amounts (5–70 wt%). The kerosene dilutes the wax in the fuel, i.e. lowers the overall weight fraction of wax, and thereby lowers the cloud point, filterability temperature, and pour point simultaneously. The additives of this invention effectively lower both the cloud point and CFPP (Cold Filter Plugging Point) of distillate fuel without any appreciable dilution of the wax component of the fuel.

Other additives known in the art have been used in lieu of kerosene to improve the low-temperature properties of distillate fuels. Many such additives are polymeric materials with pendant fatty hydrocarbon groups. These additives are limited in the range of their activity, however; most improve fuel properties by lowering the pour point and/or filterability temperature. These additives have little or no effect on the cloud point of the fuel. The additives of this invention are substantially different, however, both in terms of structure and function. They are oligomeric and/or polymeric materials obtained via condensation reactions, i.e. the reaction of diaminodiols with acids and/or arthydrides. In terms of activity, these additives effectively lower distillate fuel cloud point, thus providing improved low-temperature fuel properties, and offering a unique and useful advantage over known distillate fuel additives.

These new additives are especially effective in lowering the cloud point of distillate fuels, and thus improve the low-temperature flow properties of such fuels without the use of any light hydrocarbon diluent such as kerosene. In addition, the filterability properties are improved as demonstrated by lower CFPP temperatures. These properties make them unique multifuncitonal additives for distillate fuels. They are also unique in structure and activity. With respect to the novel compounds (adducts) of this invention, no art is known to applicants that teaches or suggests them. The additive concentrates and fuel compositions containing such additives are also unique. Similarly, the processes for making these additives, additive concentrates, and fuel compositions are unique.

SUMMARY OF THE INVENTION

This invention is directed to products made by reacting a pair of comonmers (1) diaminodiols and ( 2 ) a derivative of pyromellitic dianhydride (PMDA) or its acid equivalent, and/or (3) optionally phthalic anhydride or its acid equivalent, which have been found to improve the low-temperature properties of distillate fuels. This invention is also directed to distillate fuel compositions containing minor amounts of such products which significantly improve low-temperature flow properties, with lower cloud point and CFPP filterability temperatures.

DESCRIPTION OF SPECIFIC EMBODIMENTS

The additives of this invention have oligomeric (i.e. dimers, trimers, etc.) and/or polymeric structures. Various hydrocarbyl groups, especially groups containing linear paraffinic substructures, are distributed along the backbone of the oligomer and/or polymer, and may be carried by either or both of the comonomers used.

One of the comonomers, alone or in combination, used in the synthesis of these additives is a diaminodiol. The diaminodiols of this invention are the reaction products of a diglycidyl ether and a secondary amine. Such a diaminodiol allows the of introduction of additional linear hydrocarbyl groups along the oligomer/polymer backbone, thus increasing the overall density of linear hydrocarbyl groups in the final additive structure. However, any diaminodiol may be used in this invention and may include, but is not limited by the examples given below.

The diaminodiols found highly effective are those diols derived from the reaction of two equivalents of one secondary amine and one diglycidyl ether, according to the following general scheme:

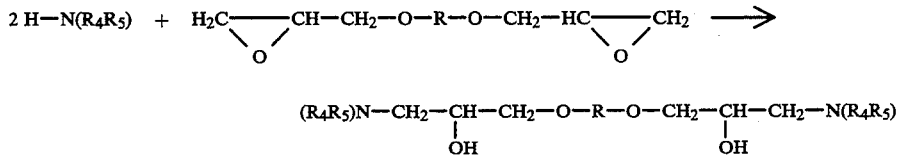

Where $R = C_1$ to about $C_{100}$ hydrocarbyl, or $C_1$ to about $C_{100}$ hydrocarbyl containing oxygen, nitrogen, sulfur, phosphorus, B, and/or Si.

$R_4 = C_8$ to about $C_{50}$ hydrocarbyl group, preferably linear, saturated or unsaturated.

$R_5 = R_4$, $C_1$ to about $C_{100}$ hydrocarbyl, or $C_l$ to about $C_{100}$ hydrocarbyl containing oxygen, nitrogen, sulfur, and/or phosphorus The other comonomer used, alone or in combination, in the synthesis of these additives is a reactive acid and/or anhydride derived from the reaction of pyromellitic dianhydride (PMDA) or its acid equivalent, and suitable pendant groups derived from alcohols and amines with some combination of linear hydrocarbyl groups attached. These pendant groups include (a) aminoalcohols, derived from a secondary amine capped with an olefin epoxide, (b) combinations of the aminoalcohol from (a) and an amine, and (c) combination of two or more different aminoalcohols.

The additives of this invention are the reaction products obtained by combining the two monomer types described above in differing ratios using standard esterification techniques according to the following stepwise procedure:

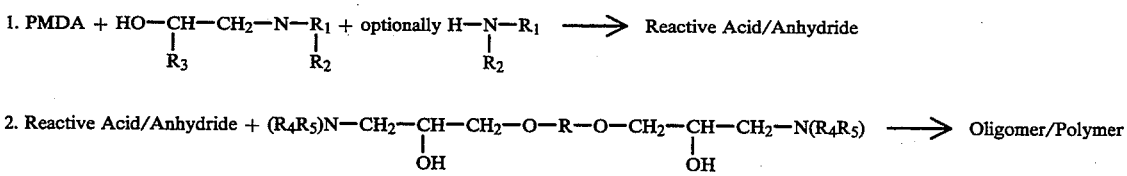

For example, a general structure for the oligomers/-polymers derived from PMDA partial ester and diaminodiol is as follows:

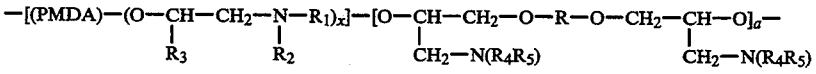

Also, oligomers/polymers analogous to these may be derived from PMDA mixed partial ester, i.e. PMDA derivatives where the pendant aminoalcohols are different from one another.

A general structure for the oligomers/polymers derived from PMDA partial ester/amide and diaminodiol is as follows:

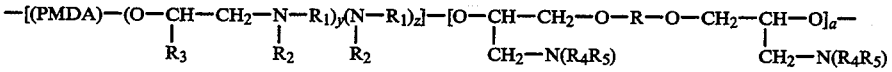

Where:

x=y+z=0.5 to about 3.5, preferably from about 1 to3.

a=0.25 to about 2, preferably from about 0.5 to 1.25.

$R_1$, $R_3$, $R_4$=$C_8$ to about $C_{50}$ linear hydrocarbyl, either saturated or unsaturated.

$R_2$=$R_1$, $C_1$ to about $C_{100}$ hydrocarbyl, or $C_1$ to about $C_{100}$ hydrocarbyl containing oxygen, nitrogen, sulfur and/or phosphorus.

$R_5$=$R_4$, $C_1$ to about $C_{100}$ hydrocarbyl, or $C_1$ to about $C_{100}$ hydrocarbyl containing oxygen, nitrogen, sulfur and/or phosphorus.

The reaction can be carried out under widely varying conditions which are not believed to be critical. The reaction temperature can vary from 100° to 225° C., preferably 150° to 190° C., under ambient or autogenous pressure. However, slightly higher pressures may be used if desired. The temperature chosen will depend upon for the most part on the particular reactants and on whether or not a solvent is used. Solvents used will typically be hydroarbon solvents such as xylene, but any non-polar, unreactive solvent can be used including benzene and toluene and/or mixtures thereof.

Molar ratios, less than molar ratios or more than molar ratios the reactants can be used. Preferentially a molar ratio of 1:1 of epoxide to amine is usually choosen.

The times for the reactions are also not believed to be critical. The process is generally carried out in from about one to twenty-four to forty-eight hours or more.

In general, the reaction products of the present invention may be employed in any amount effective for imparting the desired degeree of activity to improve the low temperature characteristics of distillate fuels. In many applications the products are effectively employed in amounts from about 0.0001% to about 10% by weight and preferably from about less than 0.01% to about 5% of the total weight of the composition. These additives may be used in conjunction with other known low-temperature fuel additives (dispersants, etc.) being used for their intended purpose.

The fuels contemplated are liquid hydrocarbon combustion fuels, including the distillate fuels and fuel oils. Accordingly, the fuel oils that may be improved in accordance with the present invention are hydrocarbon fractions having an initial boiling point of at least about 250° F. and an end-boiling point no higher than about 750° F. and boiling substantially continuously throughout their distillation range. Such fuel oils are generally known as distillate fuel oils. It is to be understood, however, that this term is not restricted to straight run distillate fractions. The distillate fuel oils can be straight run distillate fuel oils, catalytically or thermally cracked (including hydrocarcked) distillate fuel oils, or mixtures of straight run distillate rule oils, naphthas and the like, with cracked distillate stocks. Moreover, these fuel oils can be treated, in accordance with well-known commercial methods, such as, acid or caustic treatment, hydrogenation, solvent refining, clay treatment, etc.

The distillate fuel oils are characterized by their relatively low viscosities, pour points, and the like. The principal property which characterizes the contemplated hydrocarbons, however, is the distillation range. As mentioned hereinbefore, this range will lie between about 250° F. and about 750° F. Obviously, the distillation range of each individual fuel oil will cover a narrower boiling range falling, nevertheless, within the above-specified limits. Likewise, each fuel oil will boil substantially continuously throughout its distillation range.

Contemplated among the fuel oils are Nos. 1, 2 and 3 fuel oils used in heating and as diesel fuel oils, and the jet combustion fuels. The domestic fuel oils generally conform to the specification set fother in ASTM Specifications D396-48T. Specifications for diesel fuels are defined in ASTM Specification, D975-48T. Typical jet fuels are defined in Military Specification MIL-F-5624B.

The following examples are illustrative only and are not intended to limit the scope of the invention.

EXAMPLES

Example 1

Preparation of Additive

Di(hydrogenated tallow) amine (60.0 g, 0.12 mol; e.g. Armeen 2HT from Akzo Chemie), 2,2-dimethyl-1,3-propanediol diglycidyl ether (6.29 g, 0.029 mol; e.g.

Azepoxy N from AZS Corporation), and 1,2-epoxyoctadecane (24.4 g, 0.091 mol; e.g. Vilolox 18 for Viking Chemical) were combined and heated at 140° C. for three hours, and at 165° to 170° C. for 16 to 20 hours. Pyromellitic dianhydride (8.72 g, 0.040 mol; e.g. PMDA from Allco Chemical Corporation and xylene (approximately 50 ml) were added and heated at reflux (180° to 190° C.) with azeotropic removal of water for 24 hours. Volatiles were then removed from the reaction medium at 190° C., and the reaction mixture was hot filtered through diatomaceous earth to give 89.1 g of the final product.

Example 2

Preparation of Additive 2

According to the procedure used for Example 1, di(hydrogenated tallow) amine (60.0 g, 0.12 mol), 2,2'dimethyl-1,3-propanediol diglycidyl ether (10.9 g, 0.050 mol), and 1,2-epoxyoctadecane (14.2 g, 0.053 mol) were combined. Then, pyromellitic dianhydride (11.5 g, 0.053 mol) and xylene (approximately 50 ml) were added and allowed to react. After isolation, 84.7 g of the final product was obtained.

Example 3

Preparation of Additive 3

According to the procedure used for Example 1, di(hydrogenated tallow) amine (60.0 g, 0.12 mol), 1,4-butanediol diglycidyl ether (8.38 g, 0.029 mol; e.g. Araldite RD-2 from Ciba-Geigy Company), and 1,2-epoxyoctadecane (24.4 g, 0.091 mol) were combined. Then, pyromellitic dianhydride (8.72 g, 0.040 mol) and xylene (approximately 50 ml) were added and allowed to react. After isolation, 95.7 g of the final product was obtained.

Example 4

Preparation of Additive 4

According to the procedure used for Example, 1, di(hydrogenated tallow) amine (60.0 g, 0.12 mol), 1,4-butanediol diglycidyl ether (14.5 g, 0.050 mol), and 1,2-epoxyoctadecane (14.2 g, 0.053 mol) were combined. Then, pyromellitic dianhydride (11.5 g, 0.053 mol) and xylene (approximately 50 ml) were added and allowed to react. Excess xylene solvent was added to facilitate filtration of the final reaction product, and then was removed under reduced pressure. After isolation, 107.4 g of the final product was obtained.

Example 5

Preparation of Additive 5

According to the procedure used for Example 1, di(hydrogenated tallow) amine (60.0 g, 0.12 mol), a polyetherglycol diglycidyl ether with an average molar weight of 380 (11.0 g, 0.029 mol; e.g. DER 756 from Dow Chemical Company), and 1,2-epoxyoctadecane (24.4 g, 0.091 mol) were combined. Then, pyromellitic dianhydride (11.5 g, 0.040 mol) and xylene (approximately 50 ml) were added and allowed to react. After isolation, 90.2 g of the final product was obtained.

Example 6

Preparation of Additive 6

According to the procedure used for Example 1, di(hydrogenated tallow) amine (60.0 g, 0.12 mol), DER 756 (19.2 g, 0.050 mol), and 1,2-epoxyoctadecane (14.2 g, 0.055 mol) were combined. Then, pyromellitic dianhydride (11.5 g, 0.053 mol) and xylene (approximately 50 ml) were added and allowed to react. After isolation, 88.4 g of the final product was obtained.

Example 7

Preparation of Additive 7

According to the procedure used for Example 1, di(hydrogenated tallow) amine (50.0 g, 0.10 mol), a polyetherglycol diglycidyl ether with an average molar weight of 630 (15.3 g, 0.024 mol; e.g. DER 736 from Dow Chemical Company), and 1,2-epoxyoctadecane (20.3 g, 0.076 mol) were combined. Then, pyromellitic dianhydride (7.27 g, 0.053 mol) and xylene (approximately 50 ml) were added and allowed to react. After isolation, 84.0 g of the final product was obtained.

Example 8

Preparation of Additive 8

According to the procedure used for Example 1, di(hydrogenated tallow) amine (60.0 g, 0.12 mol), 2,2-dimethyl-1,3-propanediol diglycidyl ether (10.2 g, 0.047 mol), and 1,2-epoxyoctadecane (14.4 g, 0.054 mol)were combined. Then, pyromellitic dianhydride (5.14 g, 0.024 mol), phthalic anhydride (3.49 g, 0.024 mol; e.g. from Aldrich Chemical Company), and xylene (approximately 50 ml) were added and allowed to react. After isolation, 82.2 g of the final product was obtained.

Example 9

Preparation of Additive 9

According to the procedure used for Example 1, di(hydrogenated tallow) amine (60.0 g, 0.12 mol), 1,4-butanediol diglycidyl ether (13.6 g, 0.047 mol), and 1,2-epoxyoctadecane (5.14 g, 0.024 mol) were combined. Then, pyromellitic dianhydride (11.5 g, 0.053 mol), phthalic arthydride (3.49 g, 0.024 mol), and xylene (approximately 50 ml) were added and allowed to react. After isolation, 88.8 g of the final product was obtained.

Example 10

Preparation of Additive 10

According to the procedure used for Example 1, di(hydrogenated tallow) amine (60.0 g, 0.12 mol), DER 736 (17.9 g, 0.047 mol), and 1,2-epoxyoctadecane (14.4 g, 0.054 mol) were combined. Then, pyromellitic dianhydride (5.14 g, 0.024 mol), phthalic anhydride (3.49 g, 0.024 mol), and xylene (approximately 50 ml) were added and allowed to react. After isolation, 89.4 g of the final product was obtained.

Example 11

Preparation of Additive 11

According to the procedure used for Example 1, di(hydrogenated tallow) amine (50.0 g, 0.10 mol), DER 736 (24.8 g, 0.039 mol), and 1,2-epoxyoctadecane (12.0 g, 0.045 mol) were combined. Then, pyromellitic dianhydride (4.28 g, 0.020 mol), phthalic anhydride (2.91 g, 0.020 mol), and xylene (approximately 50 ml) were added and allowed to react. After isolation, 84.5 g of the final product was obtained.

Example 12

Preparation of Additive 12

According to the procedure used for Example 1, di(hydrogenated tallow) amine (61.2 g, 0.12 mol), 2,2-dimethl-1,3-propanediol diglycidyl ether (6.49 g, 0.030 mol), and 1,2-epoxyoctadecane (8.55 g, 0.030 mol) were combined. Then, pyromellitic dianhydride (6.54 g, 0.030 mol), and xylene (approximately 50 ml) were added and allowed to react. After isolation, 74.2 g of the final product was obtained.

EVALUATION

Preparation of Additive Concentrate

A concentrate solution of 100 ml total volume was prepared by dissolving 10.0 g of additive in mixed xylenes solvent. Any insoluble particulates in the concentrate were removed by filtration before use.

Test Procedures

The cloud point of the additized distillate fuel was determined using two procedures:

a. An automatic cloud point test based on the equipment/procedure detailed in U.S. Patent 4,601,303; the test designation below is AUTO CP;

b. an automatic cloud point test based on the commercially available Herzog cloud point tester; the test designation below is HERZOG.

The low-temperature filterability was determined using the Cold Filter Plugging Point (CFPP) test. This test procedure is described in Journal of the Institute of Petroleum, Volume 52, Number 510, June, 1966, pages 173–185.

The characteristics of Diesel Fuels A and B were as follows:

| Test Fuel Characteristics | FUEL A | FUEL B |
|---|---|---|
| API Gravity | 35.5 | 34.1 |
| Cloud Point, °F. | | |
| Auto CP | 15 | 22 |
| Herzog | 16.4 | 23.4 |
| CFPP, °F. | 9 | 16 |
| Pour Point, °F. | 10 | 0 |

TABLE

Test Results
Additive Effect on the Cloud Point and Filterability of Distillate Fuel (Additive Concentration = 0.1% wt
Improvement in Performance Temperature (°F.)

| | Diesel Fuel A | | | Diesel Fuel B | | |
|---|---|---|---|---|---|---|
| ADDITIVE | (AUTO CP) | (HERZOG) | CFPP | (AUTO CP) | (HERZOG) | CFPP |
| 1 | — | 2.2 | 6 | — | 70 | 9 |
| 2 | 4 | 3.4 | 4 | 11 | 6.6 | 4 |
| 3 | — | 1.6 | 6 | — | 6.7 | 9 |
| 4 | — | 3.1 | 4 | — | 6.7 | 4 |
| 5 | — | 2.2 | 6 | — | 7.7 | 4 |
| 6 | — | 3.6 | 4 | — | 6.8 | 4 |
| 7 | — | 1.8 | 6 | — | 7.4 | 11 |
| 8 | 3 | 2.0 | 4 | 10 | 5.0 | 9 |
| 9 | 3 | 2.0 | 4 | 8 | 5.6 | 7 |
| 10 | 3 | 2.0 | 4 | 8 | 5.8 | 2 |
| 11 | 4 | 2.0 | 4 | 9 | 5.0 | 2 |
| 12 | — | 1.2 | — | — | 7.9 | 6 |

The test data clearly show that the additives in accordance with the invention improve the low-temperature characteristics of distillate fuels.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims.

What is claimed is:

1. A fuel composition comprising a major amount of a liquid hydrocarbon fuel and a minor amount of an additive product of reaction comprising an oligomer/polymer made by (1) reacting a secondary amine with an olefin epoxide and a diglycidyl ether to produce a mixture of an aminoalcohol and a diaminodiol, and (2) thereafter reacting said mixture of diaminodiol and aminoalcohol with a combination of pyromellitic dianhydride and phthalic anhydride or their acid equivalents to obtain the additive product and wherein said reactants are present in molar, less than molar or more than molar ratios and the reaction temperature varies from ambient or about 100° C. to about 225° C. under pressure that varies from ambient or is autogenous with reaction times that vary from one to about 48 hours.

2. The composition of claim 1 wherein the diaminodiol is derived from a secondary amine and a diglycidyl ether and wherein the amine has the following general formula:

$$HN(R_4R_5)$$

and wherein $R_4$ is about a $C_8$ to about a $C_{50}$ hydrocarbyl group, and $R_5$ equals $R_4$, or $C_1$ to about $C_{100}$ hydrocarbyl or $C_1$ to about $C_{100}$ hydrocarbyl containing oxygen, nitrogen, sulfur and/or phosphorus.

3. The composition of claim 1 where the minor amount comprises from about 0.0001% to about 10 wt% based on the total weight of the composition.

4. The composition of claim 1 wherein the oligomer/polymer product is made by (1) reacting dihydrogenated tallow amine, 2,2-dimethyl-1,3-propanediol diglycidyl ether, and 1,2-epoxyoctadecane and (2) thereafter reacting the product of (1) with a combination of pyromellitic dianhydride and phthalic anhydride.

5. The composition of claim 1 wherein the oligomer/polymer product is made by (1) reacting dihydrogenated tallow amine, 1,4-butanediol diglycidyl ether, and 1,2-epoxyoctadecane and (2) thereafter reacting the product of (1) with a combination of pyromellitic dianhydride and phthalic anhydride.

6. The composition of claim 1 wherein the oligomer/polymer product is made by (1) reacting dihydrogenated tallow amine, a polyetherglycol diglycidyl ether, and 1,2-epoxyoctadecane and (2) thereafter reacting the product of (1) with a combination of pyromellitic dianhydride and phthalic anhydride.

7. The composition of claim 1 wherein said fuel is selected from the group consisting of distillate fuels and fuel oils.

8. The composition of claim 7 wherein said fuel is a distillate fuel oil.

9. The composition of claim 8 wherein said fuel oil is a diesel fuel oil.

10. The composition of claim 7 wherein said fuel oil is a heating fuel oil.

11. The composition of claim 7 wherein said fuel is selected from fuel oil nos. 1, 2 or 3.

12. A liquid hydrocarbyl fuel additive product of reaction to improve low-temperature properties of liquid hydrocarbon fuels comprising an oligomer/polymer made by (1) reacting a secondary amine with an olefin epoxide and a diglycidyl ether to produce a mixture of an aminoalcohol and a diaminodiol, and (2) thereafter reacting said mixture of diaminodiol and aminoalcohol with a combination of pyromellitic dianhydride and phthalic anhydride or their acid equivalents to obtain said product of reaction and wherein said reactants are present in molar, less than molar or more than molar ratios and the reaction temperature varies from ambient or about 100° C. to about 225° C. under pressure that is autogenous or ambient or is autogenous with reaction times that vary from about one to about 48 hours.

13. A method of improving the low temperature characteristics of liquid hydrocarbyl distillate fuels comprising blending a minor amount of about 0.0001% to about 10 wt % of the reaction product additive of claim 12 with a major amount of said fuel.

14. A concentrate solution comprising about 100 ml total volume suitable for use in preparing liquid hydrocarbyl fuels comprising about 10 grams of the reaction product additive of claim 12 dissolved in an inert solvent.

15. (Amended) The product of claim 14 wherein the diaminodiol is derived from a secondary amine and a diglycidyl ether and wherein the amine has the general formula:

$$HN(R_4R_5)$$

wherein $R_4$ is a $C_8$ to about a $C_{50}$ hydrocarbyl group, and $R_5$ equals a $C_1$ to about a $C_{100}$ hydrocarbyl group, or a $C_1$ to about a $C_{100}$ hydrocarbyl group containing oxygen, nitrogen, sulfur and/or phosphorus.

16. The product of claim 12 wherein the oligomer/polymer product is made by reacting (1) dihydrogenated tallow amine, 2,2-dimethyl-1,3-propanediol diglycidyl ether, and 1,2-epoxyoctadecane and (2) thereafter reacting the product of (1) with a combination of pyromellitic dianhydride and phthalic anhydride.

17. (Amended) The product of claim 12 wherein the oligomer/polymer product is made by (1) reacting dihydrogenated tallow amine, 1,4-butanediol diglycidyl ether, 1,2 epoxyoctadecane and (2) thereafter reacting the product of (1) with a combination of pyromellitic dianhydride and phthalic anhydride.

18. The product of claim 12 wherein the oligomer/polymer product is made by (1) reacting dihydrogenated tallow amine, a polyetherglycol diglycidyl ether, and 1,2-epoxyoctadecane and (2) thereafter reacting the product of (1) with a combination of pyromellitic dianhydride and phthalic anhydride.

* * * * *